US005371513A

United States Patent [19]

Drako et al.

[11] Patent Number: 5,371,513

[45] Date of Patent: Dec. 6, 1994

[54] APPARATUS FOR GENERATING PROGRAMMABLE INTERRUPTS TO INDICATE DISPLAY POSITIONS IN A COMPUTER

[75] Inventors: Dean Drako, Cupertino; Steven Roskowski, Sunnyvale, both of Calif.

[73] Assignee: Apple Computer, Inc., Cupertino, Calif.

[21] Appl. No.: 118,570

[22] Filed: Sep. 7, 1993

Related U.S. Application Data

[63] Continuation of Ser. No. 528,242, May 24, 1990, abandoned.

[51] Int. Cl.[5] ..... G09G 1/16

[52] U.S. Cl. ..... 345/118; 345/200

[58] Field of Search ..... 395/157, 164, 160; 345/200, 132, 119, 112, 118

[56] References Cited

U.S. PATENT DOCUMENTS

| | | | |
|---|---|---|---|
| 4,710,767 | 12/1987 | Sciacero et al. | 340/799 |
| 4,876,533 | 10/1989 | Barkans | 340/721 |
| 4,933,877 | 6/1990 | Hasebe | 395/158 |
| 4,954,819 | 9/1990 | Watkins | 395/164 |
| 4,961,071 | 10/1990 | Krooss | 340/721 |
| 4,980,765 | 12/1990 | Kudo et al. | 358/160 |
| 5,058,041 | 10/1991 | Rose et al. | 395/164 |
| 5,061,919 | 10/1991 | Watkins | 395/164 |
| 5,097,257 | 3/1992 | Clough et al. | 340/814 |
| 5,201,037 | 4/1993 | Kohiyama et al. | 395/164 |
| 5,216,413 | 6/1993 | Seiler et al. | 340/721 |
| 5,257,348 | 10/1993 | Roskowski et al. | 395/157 |

*Primary Examiner*—Alyssa H. Bowler
*Assistant Examiner*—L. Donaghue
*Attorney, Agent, or Firm*—Blakely, Sokoloff, Taylor & Zafman

[57] ABSTRACT

A circuit for generating programmable interrupt signals including apparatus for counting the individual rows of signals being displayed by an output display, apparatus for selectively storing a signal indicating a particular row, apparatus for determining when the signal counted by the apparatus for counting the individual rows of signals and the signal stored by the apparatus for selectively storing a signal indicating a particular row are equal, and apparatus for producing an interrupt signal when the signal counted by the apparatus for counting the individual rows of signals and the signal stored by the apparatus for selectively storing a signal indicating a particular row are equal.

29 Claims, 2 Drawing Sheets

APPARATUS FOR GENERATING PROGRAMMABLE INTERRUPTS TO INDICATE DISPLAY POSITIONS IN A COMPUTER

This is a continuation of application Ser. No. 07/528,242, filed May 24, 1990, now abandoned.

BACKGROUND OF THE INVENTION

1. Field of the Invention:

This invention relates to computer display control circuitry and, more particularly, to apparatus for generating programmable interrupts to a central processor which may be used to accomplish tear-free updating of an output display.

2. History of the Prior Art:

Computer designers are working toward providing systems which will allow an operator sitting at a personal computer to call up information on the computer output display from a number of different sources. For example, it is expected that a person will be able to hear telephone and radio communications, view television or recorded motion pictures, play stereo recordings of music, and operate computer graphical and text programs. It is also expected that all of these operations will be possible at the same time so that, for example, a television program may be displayed in one window of an output display while a computer graphics program is running in another window of the same display or computer graphics material is displayed as an overlay on the television program.

The typical computer for displaying graphical and television (video) signals uses a bitmapped display of relatively high resolution. A typical display may present 640 pixels in each horizontal row and have 480 rows of pixels. The central processing unit of such a computer may selectively vary the information at each pixel on the display in order to present the colors and intensities used for displaying the information. The pixel information is displayed by a raster beam which sweeps horizontally across the 480 rows one at a time to describe a single frame typically once every sixtieth of a second.

In general, when multiple programs are presented, such bit-mapped displays present the different programs in different windows. Such a window is an area of the display, often a rectangle, which may display a program while one or more other programs are running (or presenting a background display) on the remainder of the output display.

In computer systems used to display graphical or video information in which the information is being rapidly updated, a situation may occur in which the information in a particular window is being updated while the raster beam of the cathode ray tube providing the output display is moving across the window. In such a case, the beam may catch up with the transfer of information to the frame buffer from which the display is refreshed or the transfer of information may catch up with the beam so that the picture displayed in the window comes from two different frames. If the window is presenting rapid movement, this results in a flickering on the output display called a "frame tear." Although the flickering takes place over a very short period of time (less than one tenth of a second), it is very disturbing to the viewer and unacceptable when producing an animated graphical output or a video display.

The tearing of frames may be eliminated if the transfer of information to a window may be made to occur only during periods in which the raster beam is in safe areas of the display so that interference between the beam and the transfer cannot occur.

SUMMARY OF THE INVENTION

It is, therefore, a general object of the present invention to eliminate frame tearing in computer displays.

It is another more specific object of the present invention to provide apparatus for generating interrupts or other synchronization signals which may be used to indicate when a transfer can be performed such that it will not interfere with the raster refresh.

These and other objects of the present invention are realized in a control circuit for a computer output display comprising a timing generator circuit for providing synchronization and blanking signals for a display monitor, means for furnishing signals to the timing generator circuit to indicate the end of a display line, means for counting the number of lines traversed in a computer display by the raster beam and for providing a signal to the timing generator circuit when all of the lines of the display have been transversed, means for selectively providing a line number at which an interrupt is desired, means for comparing the result of the count by the means for counting the number of lines traversed in a computer display by the raster beam and the number of the line at which an interrupt is desired and generating an output signal when the two are equal which output signal may be used by a computer to generate an interrupt signal.

These and other objects and features of the invention will be better understood by reference to the detailed description which follows taken together with the drawings in which like elements are referred to by like designations throughout the several views.

NOTATION AND NOMENCLATURE

Some portions of the detailed description which follows are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to apparatus for operating a computer in processing electrical or other (e.g. mechanical, chemical) physical signals to generate other desired physical signals.

DETAILED DESCRIPTION OF THE INVENTION

Figure 1:
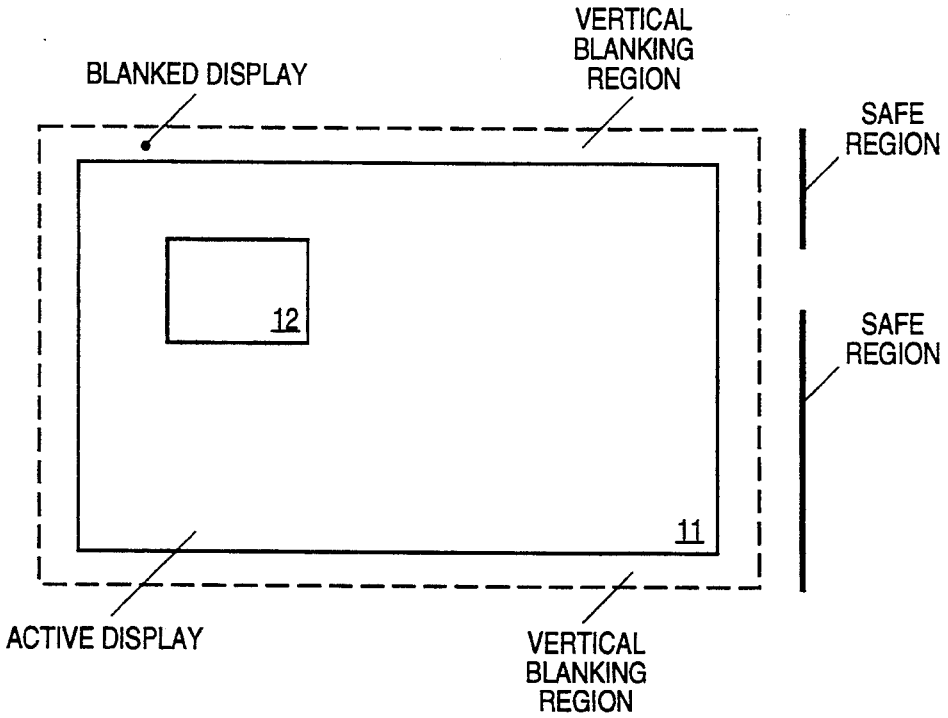
FIG. 1 is a diagram illustrating a computer output display.

Referring now to FIG. 1, there is illustrated the face of a computer output cathode ray tube display 10, The display 10 includes a large generally-rectangular area 11 on which information is presented. Typically this entire area 11 is used to display a single application program when used in the most basic manner. However, it is well known to include windows which overlie the display area 11 and each present independent application programs. Shown within the area 11 is a single additional window 12 in which may be displayed program information separate from the information displayed in the remainder of the area 11. For example, the area 11 might display background text information from a first application program while the window 12 displays graphical information from succeeding frames of an animated display.

As is well known to those skilled in the art, an animated sequence running on a computer output display or in a window on such a display is created by presenting a series of complete individual pictures one after another in rapid order. In general, each individual picture varies but slightly from the preceding and succeeding pictures so that when presented rapidly one after another, the pictures give the visual impression of smoothly varying motion. The individual pictures are stored as electrical signals representing the individual pixels in a frame buffer. A frame buffer is a large array of rows and columns of storage devices usually having a plurality of storage bits representing each position of the output display. The frame buffer is repeatedly scanned in synchronization with the raster beam of the cathode ray tube. This causes the picture contents of the frame buffer to be displayed repeatedly on the output display. When the contents of the frame buffer are changed, the display will change the next time the frame buffer is scanned by the refreshing.

Figure 2:
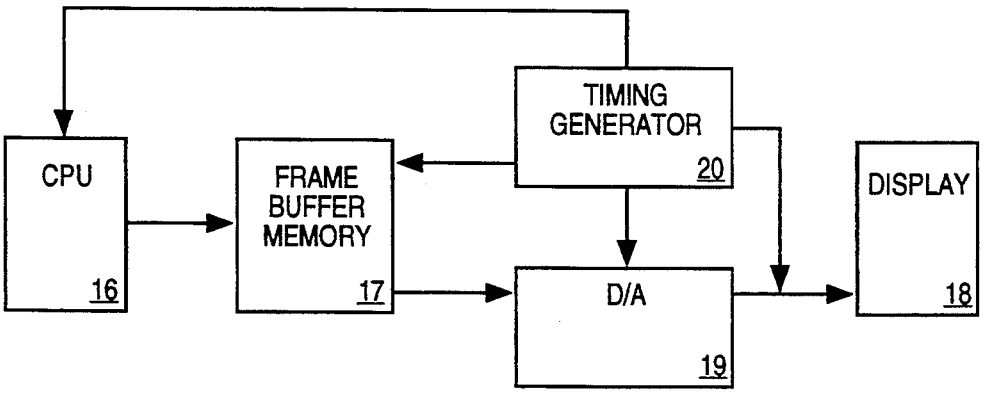
FIG. 2 is a block diagram of a prior art circuit for presenting information on a computer output display.

FIG. 2 illustrates a typical arrangement 15 for presenting information on a computer output display. The arrangement 15 includes a central processing unit 16 which controls the operation of the computer, a frame buffer memory 17 in which the central processing unit 16 stores the data for each individual frame to be presented, and an output display 18 which is preferably a cathode ray tube. A digital-to-analog converter 19 is typically disposed between the frame buffer 17 and the display 18 to convert the digital information stored in the frame buffer 17 to represent each pixel as analog information for driving the display 18. The information transferred from the frame buffer 17 is transferred serially to the display 18 through the digital-to-analog converter 19 beginning at the left side of the top line and continuing to the right edge of that line; as each line is completed, the next lower line is begun. As information in one line is transferred from the frame buffer 17 to the display 18, new information may be provided to refresh the frame buffer 17 with the next frame to be presented on the display 18. Commonly, these two operations are not synchronized. Although other circuitry is obviously necessary to the operation of a computer, only that germane to the operation of the invention is included in FIG. 2.

The arrangement 15 does include a timing generation circuit 20 which operates with an individual display 18 to provide those signals necessary to control the presentation of the pixel information on the screen of the display 18. In general, these signals include a signal for starting the raster beam at the upper left hand corner of the display 18, a clock for incrementing the beam pixel-by-pixel across the screen in a horizontal direction, a signal for indicating the end of a horizontal line (row) so that the beam may retrace to start the next line without the retrace being shown on the display 18, and a signal for indicating when the lower right-hand corner of the display is reached so that the beam may retrace to the upper left-hand corner of the display 18 to start the next frame without the vertical beam retrace being displayed. This last signal generates a system interrupt called a vertical retrace interrupt which is directed to the central processing unit 16. In the prior art, this interrupt is available only at the time the vertical retrace commences.

In order to provide the information to be presented by the display, the so-called raster refresh, the information in the frame buffer is continuously shifted out of the frame buffer row-by-row in the same order as the information is displayed on the display. However, the frame buffer is typically filled on a more random basis by the central processing unit only with information which is being updated. Thus, for example, if a window is presenting graphical animated material, it is probable that only this window will be updated from frame to frame over some period of time. The updating of the window often occurs row-by-row of the window from left-to-right and from top-to-bottom. Depending on the speed at which the frame buffer is updated and the constant rate at which the information is shifted out of the frame buffer to the display, it is possible that a display of an animated program will include information which is from two sequential frames. If so, the information in part of the window is offset in time from that in the other part of the window; that is, a frame tear occurs.

However, if in the display 11 of FIG. 1, the contents of the window 12 are transferred to the frame buffer in a fixed maximum amount of time, then a safe period may be determined for accomplishing the transfer in which frame tearing cannot occur. These safe regions are illustrated in FIG. 1 by the heavy vertical lines to the right of the display 10. If the display raster beam is in the upper safe region, and transfer of information to the window in the frame buffer commences, the raster beam will not catch up to the transfer. If the raster beam is in the lower safe region of the display, the transfer of information to the window in the frame buffer will not catch up with the raster beam. In either case, frame tearing is eliminated. The actual extent of the safe regions will be better understood from the detailed explanation which follows.

Figure 3:
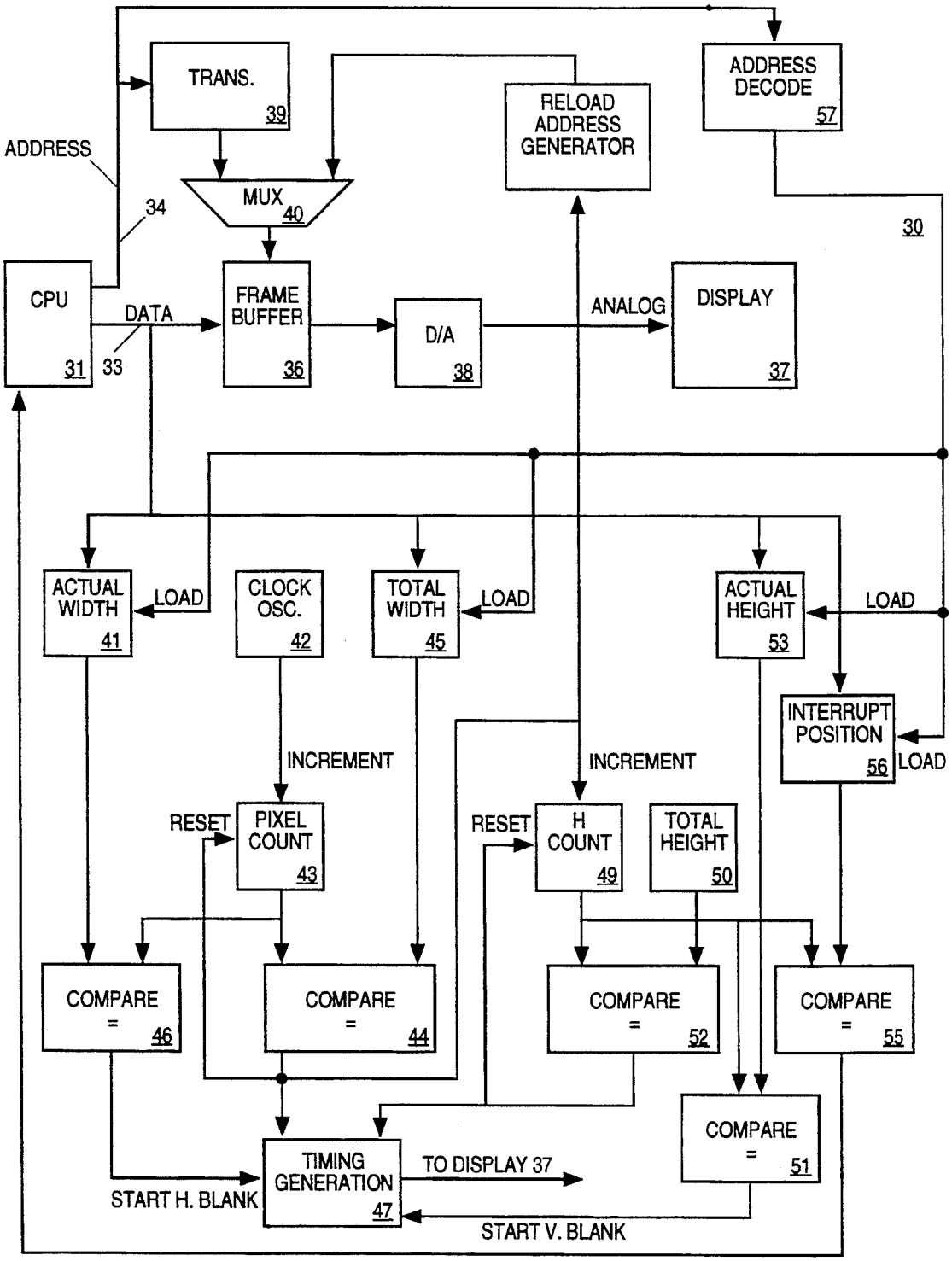
FIG. 3 is a block diagram of a circuit designed in accordance with the present invention.

FIG. 3 illustrates an arrangement 30 constructed in accordance with the invention which may be used to signal these raster beams locations to the central processing unit. The arrangement 30 includes a central processing unit 31 which provides output information on a data bus 33 and an address bus 34. The information on the data bus 33 is transferred to the random access input port of a frame buffer memory 36 which is conventionally constructed of video random access memory. Video random access memory includes an arrangement for shifting out information from the frame buffer memory 36 an entire line at one time so that it may be rapidly transferred to a display 37 by a digital-to-analog converter circuit 38. The addressing information on the address bus 34 is transferred by a translator circuit 39 and a multiplexor 40 to the frame buffer memory 36 to control the position in the frame buffer memory 36 to which each pixel presented on the data bus 33 is directed. The translator circuit 39 maps the location specified by the central processing unit 31 to the appropriate location in the frame buffer memory 36.

The timing signals for the display 37 are generated using pulses from a clock oscillator circuit 42 which provides a pulse for each pixel to be presented on the output display 37 and for the blanking periods. These pulses are provided to a pixel counter 43 which increments by one count with each pulse. The count in the pixel counter 43 is furnished to a comparator 44 and a comparator 46. The comparator 46 also receives a value from a register 41 equal to the number of pixels to be displayed on a line, while the comparator circuit 44 also receives a value from a register 45 equal to the number of pixels in each line of the display 37 including the number of pixels which are blanked during horizontal retrace. When the value of pixels counted by the comparator 46 equals the value in the register 41, the comparator 46 provides a signal to a timing generator circuit 47 to indicate the completion of a visible line of the display. The timing generator circuit 47 then initiates the horizontal blanking signal so the horizontal retrace (about 20% of the total line count) is not shown on the display 37. The comparator 44 continues to count pixels until the end of the horizontal retrace period at which time a signal is generated to cause the timing generator circuit 47 to start the next horizontal line. The signal from the comparator 44 is also transferred back to reset to zero the count in the pixel counter 43 for the next horizontal line to be described on the display 37.

In addition, the signal from the comparator 44 is transferred to a horizontal line counter 49 which counts the lines as they are displayed on the display 37. The value in the horizontal line counter 49 and a value held in a horizontal count register 50 are compared in a comparator 52. The value in the horizontal line counter 49 and a value in an actual height register 53 are compared in a comparator 51. The value in the actual height register 53 is the total number of lines to be presented on the display 37 so that when the values compare in the comparator 51 the last visible line of the display 37 has been reached. A signal is sent from the comparator 51 to the timing generator circuit 47 to indicate this fact, and the timing generator circuit 47 generates a vertical blanking signal causing the beam to retrace to the beginning of the display 37 while blanking the beam so that the vertical retrace does not appear on the display 37. The value in the horizontal line counter 49 and a value held in a total horizontal count register 50 are compared in a comparator 52. The value in the horizontal count register 50 is the total number of lines to be presented on the display 37 plus a number of blanked lines sufficient to allow for the vertical retrace to take place so that when the values compare in the comparator 52, the last line of the display 37 has been reached. The end of the vertical retrace causes a signal from the comparator 52 to begin the next frame and to reset the horizontal line counter 49 to zero for the next frame to be presented on the display 37.

It will be noted that the blanked portion of the screen during vertical retrace provides the overlap illustrated in FIG. 1 beyond the actual display area. This amounts to from 15% to 20% of the total number of lines and is a significant portion of the safe region described above.

In order to provide a programmable interrupt signal to accomplish the purposes of this invention, the value held in the horizontal line counter 49 is also transferred to line comparator 55. The comparator 55 receives a second signal from a horizontal interrupt position register 56. The value in the horizontal interrupt position register 56 is provided by the central processing unit 31 to bus 33 and is directed to that register by an address from the central processing unit 31 on the address bus 34 provided through an address decoder circuit 57. Since the value in the horizontal interrupt position register 56 is programmable, the central processing unit 31 may select the position on the display 37 (whether blanked or active) at which the comparator 55 provides an output signal.

The output signal from the comparator 55 is returned to the central processing unit 31 to generate an interrupt which may be selected to occur at a predetermined position to indicate the start of one of the safe regions so that the frame buffer memory 36 may receive information in a selected window at a time at which the receipt will not interfere with the raster beam and no frame tearing will occur.

A particular arrangement 15 may include a number (for example, eight) individual horizontal interrupt position registers so that central processing unit interrupts may be generated for a number of different windows during each refresh of the display 37. This allows a great number of individual horizontal interrupt positions to be programmed at the same time.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A circuit for a computer output display, said circuit comprising a display monitor, a single memory frame buffer coupled to receive image data from a CPU asynchronously with a raster beam update and coupled to supply image data in a same order as image data is displayed on the display monitor by the raster beam update, a timing generator circuit for providing synchronization and blanking signals for the display monitor, means for furnishing signals to the timing generator circuit to indicate the end of a display line, means for counting the number of lines including blanked lines traversed in a computer display by the raster beam and providing a signal to the timing generator circuit when all of the lines of the display have been traversed, means for selectively providing a line number at which an interrupt signal is desired, means for comparing the result of the count by the means for counting the number of lines traversed in a computer display by the raster beam and the number of the line at which an interrupt is desired and generating an output signal when the two are equal which output signal may be used as the interrupt signal to a computer in order to cause the computer to update image data within the single frame buffer memory without causing frame tears while the single memory frame buffer supplies image data for display on said display monitor.

2. A circuit for generating programmable interrupt signals, said circuit comprising a single memory frame buffer coupled to receive image data from a CPU asynchronously with a raster beam update and coupled to supply image data in a same order as image data is displayed on an output display by the raster beam update, means for counting the individual rows of signals being displayed by the output display and being blanked on the output display, means for selectively storing a signal indicating any particular row, means for determining when the signal counted by the means for counting the individual rows of signals and the signal stored by the means for selectively storing a signal indicating any particular row are equal, and means for producing an interrupt signal to the CPU when the signal counted by the means for counting the individual rows of signals and the signal stored by the means for selectively storing a signal indicating any particular row are equal, said interrupt signal for commencing an update of the image data of said single memory frame buffer to prevent display tears while said single memory frame buffer supplies image data for display on said output display.

3. A circuit for generating programmable interrupt signals for a single memory frame buffer output display system as claimed in claim 2 in which the means for selectively storing a signal indicating any particular row is capable of storing a plurality of signals indicating a plurality of rows, and wherein the means for determining when the signal counted by the means for counting the individual rows of signals and the signal stored by the means for selectively storing a signal indicating any particular row are equal responds to each of the plurality of signals indicating a plurality of rows.

4. A circuit for generating programmable video refresh interrupts for a computer output display capable of displaying a given number of horizontal lines and then providing a vertical retrace period, comprising:

a single memory frame buffer coupled to receive image data from a CPU asynchronously with a raster beam update and coupled to supply image data in a same order as image data is displayed on the computer output display by the raster beam update;

means for counting the number of visible lines displayed on the computer output display and the number of blank lines represented by the vertical retrace period; and means for selecting any of the visible or blank lines for generating a video refresh interrupt signal to said CPU for commencing an update of the image data of said single memory frame buffer to prevent display tears while said single memory frame buffer supplies image data for display on said computer output display.

5. A circuit for generating programmable video refresh interrupts for a computer output display as claimed in claim 4 in which the means for counting the number of visible lines displayed on the computer output display and the number of blank lines represented by the vertical retrace period comprises means for generating a horizontal line count signal, means for comparing the horizontal line count signal with a signal representing a total number of visible lines to be displayed on the computer output display to cause the generation of a vertical blanking signal, means for comparing the horizontal line count signal with a signal representing a total number of both visible lines to be displayed on the computer output display and lines to be blanked to cause the generation of a signal indicating the end of vertical blanking and for resetting the horizontal line count signal.

6. A circuit for generating programmable video refresh interrupts for a computer output display as claimed in claim 4 in which the means for selecting any of the visible or blank lines for generating a video refresh interrupt signal comprises means for storing a signal indicating a particular visible or blank lines for generating a video refresh interrupt signal at which a video refresh interrupt signal is desired, and means for comparing the signal stored by the last mentioned means with line value counted by the means for counting the number of visible lines displayed on the computer output display and the number of blank lines represented by the vertical retrace period.

7. A circuit for generating programmable video refresh interrupts for a computer output display as claimed in claim 4 in which the means for counting the number of visible lines displayed on the computer output display and the number of blank lines represented by the vertical retrace period comprises means for generating a horizontal line count signal, means for comparing the horizontal line count signal with a signal representing a total number of visible lines to be displayed on the computer output display to cause the generation of a vertical blanking signal, means for comparing the horizontal line count signal with a signal representing a total number of both visible lines to be displayed on the computer output display and lines to be blanked to cause the generation of a signal indicating the end of vertical blanking and for resetting the horizontal line count signal; and in which the means for selecting any of the visible or blank lines for generating a video refresh interrupt signal comprises means for storing a signal indicating a particular visible or blank lines for generating a video refresh interrupt signal at which a video refresh interrupt signal is desired, and means for comparing the signal stored by the last mentioned means with the horizontal line count signal.

8. A circuit for generating programmable video refresh interrupts for a computer output display as claimed in claim 4 in which the means for selecting any of the visible or blank lines for generating a video refresh interrupt signal comprises means for selecting a plurality of visible or blank lines for generating a video refresh interrupt signal.

9. In a computer system having a display means for displaying graphic images, an apparatus for updating images on said display means without frame tears, said apparatus comprising:

a single memory image buffer for storing an image that is scanned by a raster scan operation in a same order as said image is displayed on said display means and also for receiving image data transferred by a CPU asynchronously with said raster scan operation, said single memory image buffer coupled to receive image data transferred by said CPU and coupled to supply image data to said display means;

indicator means for indicating when a raster beam of said raster scan operation reaches an end of a video display line;

counting means for counting a number of lines scanned by said raster scan operation, said counting means responsive to said indicator means; and interrupt generation means for generating an interrupt to said CPU of said computer system when said counting means reaches a programmable count value, said interrupt for signaling said CPU that said image data may be transferred by said CPU to said single memory image buffer without causing a frame tear while said single memory image buffer supplies image data to said display means.

10. An apparatus for updating images on said display means without frame tears as described in claim 9 further comprising:

storage means responsive to said CPU for storing said programmable count value, said storage means coupled to receive said programmable count value from said CPU; and comparison means coupled to said storage means and coupled to said counting means for signaling said interrupt generation means if said counting means reaches said programmable count value.

11. An apparatus for updating images on said display means without frame tears as described in claim 10 wherein said counting means comprises means for counting a number of lines of said display means including blanked lines scanned by said raster beam of said raster scan operation.

12. An apparatus for updating images on said display means without frame tears as described in claim 10 wherein said programmable count value varies depending on a particular portion of said image of said single memory image buffer that is to be updated by said CPU.

13. An apparatus for updating images on said display means without frame tears as described in claim 10 wherein said programmable count value varies depending on whether said raster scan operation is faster or slower than a rate at which said single memory image buffer is updated with said image data by said CPU.

14. An apparatus for updating images on said display means without frame tears as described in claim 10 wherein said storage means comprises secondary storage means for storing a plurality of count values indicating a plurality of rows and wherein said interrupt generation means comprises means for generating a separate interrupt signal to said CPU at each instance that said counting means reaches one of said plurality of count values.

15. An apparatus for updating images on said display means without frame tears as described in claim 10 wherein said counting means comprises:

means for generating a horizontal line count signal;

means for comparing said horizontal line count signal with a signal representing a total number of visible lines to be displayed on the said display means to cause generation of a vertical blanking signal; and means for comparing said horizontal line count signal with a signal representing a total number of both visible lines to be displayed on said display means and lines to be blanked to cause generation of a signal indicating an end of vertical blanking and for resetting said horizontal line count signal.

16. An apparatus for updating images on said display means without frame tears as described in claim 10 further comprising raster scan means for performing said raster scan operation of said single memory image buffer while said single memory image buffer receives said image data transferred by said CPU in response to said interrupt.

17. In a computer system having a display screen for displaying graphic images for visualization and a CPU for executing instructions and processing said graphic images, a circuit arrangement for updating images on said display screen without frame tears, said circuit arrangement comprising:

a single memory image buffer for storing an image that is scanned by a raster scan operation in a same order as said image is displayed on said display screen and also for receiving image data transferred by said CPU asynchronously with said raster scan operation, said single memory image buffer coupled to receive image data transferred by said CPU and coupled to supply image data to said display screen;

signal generation logic for indicating when a raster beam of said raster scan operation reaches an end of a video display line of said display screen;

a counter for counting a number of lines scanned by said raster scan operation, said counter responsive to said signal generation logic; and interrupt signal generator for generating an interrupt to said CPU of said computer system when said counter reaches a programmable count value, said interrupt for signaling said CPU that said image data may be transferred by said CPU to said single memory image buffer without causing a frame tear on said display screen while said single memory image buffer supplies image data to said display screen.

18. A circuit arrangement for updating images on said display screen without frame tears as described in claim 17 further comprising:

a storage register responsive to said CPU for storing said programmable count value, said storage register coupled to receive said programmable count value from said CPU; and a comparator coupled to said storage register and coupled to said counter for signaling said interrupt signal generator if said counter reaches said programmable count value.

19. A circuit arrangement for updating images on said display screen without frame tears as described in claim 18 wherein said counter comprises circuitry for counting a number of lines of said display screen including blanked lines scanned by said raster beam of said raster scan operation.

20. A circuit arrangement for updating images on said display screen without frame tears as described in claim 18 wherein said programmable count value varies based on said raster scan operation being faster or slower than a rate at which said single memory image buffer is updated with said image data by said CPU.

21. A circuit arrangement for updating images on said display screen without frame tears as described in claim 18 wherein said storage register comprises a plurality of secondary storage registers for storing a plurality of count values indicating a plurality of rows and wherein said interrupt signal generator comprises circuitry for generating a separate interrupt signal to said CPU at each instance said counter reaches one of said plurality of count values.

22. A circuit arrangement for updating images on said display screen without frame tears as described in claim 18 wherein said counter comprises:

circuitry for generating a horizontal line count signal;

circuitry for comparing said horizontal line count signal with a signal representing a total number of visible lines to be displayed on the said display screen to cause generation of a vertical blanking signal; and circuitry for comparing said horizontal line count signal with a signal representing a total number of both visible lines to be displayed on said display screen and lines to be blanked to cause generation of a signal indicating an end of vertical blanking and for resetting said horizontal line count signal.

23. In a computer system having a display screen for displaying graphic images and a CPU for executing instructions and processing said graphic images, a method of updating images on said display screen without producing frame tears, said method comprising the steps of:

scanning image data stored in a single memory image buffer to update said display screen through a raster scan operation, said step of scanning image data performed at a first rate and in a same order as said image data is displayed on said display screen;

transferring additional image data by said CPU into said single memory image buffer, said step of transferring image data performed at a second rate different from said first rate;

indicating when a raster beam of said raster scan operation reaches an end of a video display line of said display screen;

counting a number of lines scanned by said raster scan operation, said step of counting responsive to said step of indicating; and generating an interrupt to said CPU of said computer system when said step of counting reaches a programmable count value, said interrupt signaling to said CPU that said additional image data may be transferred by said CPU to said single memory image buffer without causing a visible frame tear on said display screen, wherein said step of scanning image data occurs simultaneously with said step of transferring said additional image data by said CPU in response to said interrupt.

24. A method of updating images on said display screen without frame tears as described in claim 23 further comprising the steps of:

storing said programmable count value supplied by said CPU into a storage means;

comparing said count value of said storage means to a count value produced by said step of counting; and signaling said step of generating an interrupt if said step of counting reaches said programmable count value.

25. A method of updating images on said display screen without frame tears as described in claim 24 wherein said step of counting comprises the step of counting a number of lines of said display screen including blanked lines scanned by said raster beam of said raster scan operation.

26. A method of updating images on said display screen without frame tears as described in claim 24 wherein said programmable count value varies depending on a particular portion of said image of said single memory image buffer that is to be updated by said CPU.

27. A method of updating images on said display screen without frame tears as described in claim 24 wherein said programmable count value varies depending on whether said raster scan operation is faster or slower than a rate at which said single memory image buffer is updated with said additional image data by said CPU.

28. A method of updating images on said display screen without frame tears as described in claim 24 wherein said step of storing said programmable count value comprises the step of storing a plurality of count values into a plurality of secondary storage registers, said plurality of count values indicating a plurality of rows and wherein said step of generating an interrupt comprises the step of generating a separate interrupt signal to said CPU at each instance said step of counting reaches one of said plurality of count values.

29. A method of updating images on said display screen without frame tears as described in claim 24 wherein said step of counting comprises the steps of:

generating a horizontal line count signal;

comparing said horizontal line count signal with a signal representing a total number of visible lines to be displayed on the said display screen to cause generation of a vertical blanking signal;

comparing said horizontal line count signal with a signal representing a total number of both visible lines to be displayed on said display means and lines to be blanked to cause generation of a signal indicating an end of vertical blanking; and resetting said horizontal line count signal.

* * * * *